US009773468B2

(12) United States Patent
Woo et al.

(10) Patent No.: US 9,773,468 B2
(45) Date of Patent: Sep. 26, 2017

(54) DISPLAY DRIVING DEVICE FOR DRIVING EACH OF MORE THAN TWO PIXELS, DISPLAY APPARATUS AND METHOD FOR OPERATING THE SAME

(71) Applicant: SAMSUNG ELECTRONICS CO., LTD., Suwon-si, Gyeonggi-do (KR)

(72) Inventors: Jae-Hyuck Woo, Osan-si (KR); Won-Sik Kang, Seoul (KR); Yang-Hyo Kim, Suwon-si (KR); In-Suk Kim, Suwon-si (KR); Jong-Kon Bae, Seoul (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 65 days.

(21) Appl. No.: 14/178,376

(22) Filed: Feb. 12, 2014

(65) Prior Publication Data

US 2014/0253532 A1 Sep. 11, 2014

(30) Foreign Application Priority Data

Mar. 5, 2013 (KR) ..... 10-2013-0023507

(51) Int. Cl.

| | |
|---|---|
| ***G09G 5/00*** | (2006.01) |
| ***G09G 3/20*** | (2006.01) |
| ***G09G 3/36*** | (2006.01) |

(52) U.S. Cl.

CPC ..... *G09G 5/00* (2013.01); *G09G 3/20* (2013.01); *G09G 3/3685* (2013.01); *G09G 2300/0408* (2013.01); *G09G 2300/0426* (2013.01); *G09G 2310/0275* (2013.01); *G09G 2310/0286* (2013.01); *G09G 2310/0289* (2013.01); *G09G 2310/0291* (2013.01)

(58) Field of Classification Search

CPC ... G09G 2310/0286; G09G 2310/0291; G09G 2300/0408; G09G 2300/0426; G09G 2310/0275; G09G 2310/0289; G09G 3/20; G09G 3/3685; G09G 5/00

See application file for complete search history.

(56) References Cited

U.S. PATENT DOCUMENTS

| | | | | |
|---|---|---|---|---|
| 6,366,065 | B1 * | 4/2002 | Morita | 323/280 |
| 6,806,860 | B2 * | 10/2004 | Saito et al. | 345/98 |
| 7,808,320 | B1 * | 10/2010 | Kuo | 330/255 |
| 8,144,100 | B2 * | 3/2012 | Woo et al. | 345/98 |
| 2010/0295841 | A1 * | 11/2010 | Matsuda et al. | 345/213 |
| 2012/0188224 | A1 * | 7/2012 | Lee et al. | 345/214 |

* cited by examiner

*Primary Examiner* — Ram Mistry
(74) *Attorney, Agent, or Firm* — F. Chau & Associates, LLC

(57) ABSTRACT

A display driving device includes a first source amplifier that receives first display data and supplies a first pixel voltage to a first pixel based on the received first display data, and a second source amplifier that receives second display data and first control data and supplies a second pixel voltage to a second pixel based on the received second display data and first control data. The second source amplifier has a first stage in which a first process is performed on an input signal based on the second display data, and a second stage in which a second process is performed on the first processed input signal to output the second pixel voltage. The first source amplifier may be configured to conditionally supply the first pixel voltage to the second pixel.

8 Claims, 17 Drawing Sheets

1000

1100

1200

DISPLAY DRIVING DEVICE FOR DRIVING EACH OF MORE THAN TWO PIXELS, DISPLAY APPARATUS AND METHOD FOR OPERATING THE SAME

CROSS-REFERENCE TO RELATED APPLICATION

This application claims priority under 35 U.S.C. 119 to Korean Patent Application No. 10-2013-0023507 filed on Mar. 5, 2013, the disclosure of which is incorporated by reference herein in its entirety.

TECHNICAL FIELD

The inventive concept relates to a display driving device, a display apparatus including the same, and a method for operating the same.

DISCUSSION OF THE RELATED ART

With the increased portability and progress of miniaturization of various electronic products along with technological advances, there is a growing demand for display drive integrated circuits (DDIs) for driving display panels.

Along with increased portability of electronic products, batteries came into use power sources for many electronic products. Thus, power consumption of DDIs affects battery life. In addition, according to the tendency toward miniaturization of electronic products, it is also desirable to reduce the area that a DDI occupies in an electronic product.

SUMMARY

An aspect of the inventive concept provides a display driving device having reduced power consumption in operation.

An aspect of the inventive concept also provides a display driving device, which can be manufactured having a reduced size.

An aspect of the inventive concept also provides a small-sized display apparatus, which can be operated with low power consumption by employing the display driving device.

An aspect of the inventive concept also provides a method for operating the display driving device.

These and other objects of the inventive concept will be described in or be apparent from the following description of the preferred embodiments.

According to an aspect of the inventive concept, there is provided a display driving device including a first source amplifier that receives first display data and supplies a first pixel voltage to a first pixel based on the received first display data, and a second source amplifier that receives second display data and first control data and supplies a second pixel voltage to a second pixel based on the received second display data and first control data, wherein the second source amplifier has a first stage in which a first process is performed on an input signal based on the second display data, and a second stage in which a second process is performed on the first processed input signal to output the second pixel voltage, when the first control data is first data, the first and second stages are both enabled to allow the second source amplifier to supply the second pixel voltage to the second pixel, and when the first control data is second data different from the first data, the first stage is enabled and the second stage is disabled to allow the first source amplifier to supply the first pixel voltage to the second pixel.

According to an aspect of the inventive concept, there is provided a display driving device including a data compare block that receives display data through an input pad and generates control data from the display data, a logic block that has the data compare block disposed therein and outputs the control data generated from the data compare block, and a source driver that supplies a pixel voltage to first and second pixels through different source amplifiers according to the display data and control data supplied from the logic block or supplies the pixel voltage to the first and second pixels through one source amplifier.

According to an aspect of the inventive concept, there is provided a display apparatus including a panel including a pixel; and a source driver including a source amplifier configured to receive display data and control data and supply a pixel voltage to the pixel based on the received display data and control data, wherein the source amplifier includes a first stage which is always enabled irrespective of the control data and performs a first process which processing an input signal based on the display data, and a second stage which is enabled according to the control data and performs a second process which processing the first processed input signal and then outputting the pixel voltage.

According to an aspect of the inventive concept, there is provided a method for operating a display driving device, the method including providing a pixel and first and second source amplifiers to supply a pixel voltage to the pixel, and supplying the pixel voltage to the pixel through one of the first and second source amplifiers according to control data, wherein the first and second source amplifiers have a first stage in which a first process is performed on an input signal based on the display data, and a second stage in which a second process is performed on the first processed input signal to output the pixel voltage, respectively, when the control data is first data, the first and second stages are both enabled to allow the second source amplifier to supply the pixel voltage to the pixel, and when the control data is second data, the first stage of the second source amplifier is enabled and the second stage of the second source amplifier is disabled to allow the first source amplifier to supply the pixel voltage to the pixel.

Features of the inventive concept and methods of implementing the same may be understood more readily by reference to the following detailed description of preferred embodiments and the accompanying drawings. The inventive concept may, however, be embodied in many different forms and should not be construed as being limited to an exemplary embodiments set forth herein. Rather, these embodiments are provided so that this disclosure will be thorough and complete and will fully convey the concept of the inventive concept to those skilled in the art, and the inventive concept will only be defined by the appended claims. In the drawings, the thickness of layers and regions are exaggerated for clarity.

It will be understood that when an element or layer is referred to as being "on" or "connected to" another element or layer, it can be directly on or connected to the other element or layer or intervening elements or layers may be present. In contrast, when an element is referred to as being "directly on" or "directly connected to" another element or layer, there are no intervening elements or layers present. Like numbers refer to like elements throughout. As used herein, the term "and/or" includes any and all combinations of one or more of the associated listed items.

The use of the terms "a" and "an" and "the" and similar referents in the context of describing the inventive concept (especially in the context of the following claims) are to be construed to cover both the singular and the plural, unless otherwise indicated herein or clearly contradicted by context. The terms "having," "including," and "containing" are to be construed as open-ended terms (i.e., meaning "including, but not limited to,") unless otherwise noted.

It will be understood that, although the terms first, second, etc. may be used herein to describe various elements, these elements should not be limited by these terms. Unless the context indicates otherwise, these terms are only used to distinguish one element from another element (e.g., among a plurality). Thus, for example, a first element, a first component or a first section discussed below could be termed a second element, a second component or a second section without departing from the teachings of the inventive concept.

Unless defined otherwise, all technical and scientific terms used herein have the same meaning as commonly understood by one of ordinary skill in the art to which this inventive concept belongs. It is noted that the use of any and all examples, or exemplary terms provided herein is intended merely to better illuminate the inventive concept and is not a limitation on the scope of the inventive concept unless otherwise specified.

BRIEF DESCRIPTION OF THE DRAWINGS

The above and other features of the inventive concept will become more apparent by describing in detail preferred embodiments thereof with reference to the attached drawings in which:

FIG. 6 is the circuit diagram of the display driving device FIG. 1 including data paths for illustrating an operating method thereof;

FIG. 7 is a timing diagram of signals in the display driving device FIG. 1;

FIG. 8 is a timing diagram of signals in the display driving device FIG. 1;

DETAILED DESCRIPTION OF THE EXEMPLARY EMBODIMENTS OF THE INVENTIVE CONCEPT

A display driving device according to an exemplary embodiment of the inventive concept will now be described with reference to FIG. 1.

Figure 1:
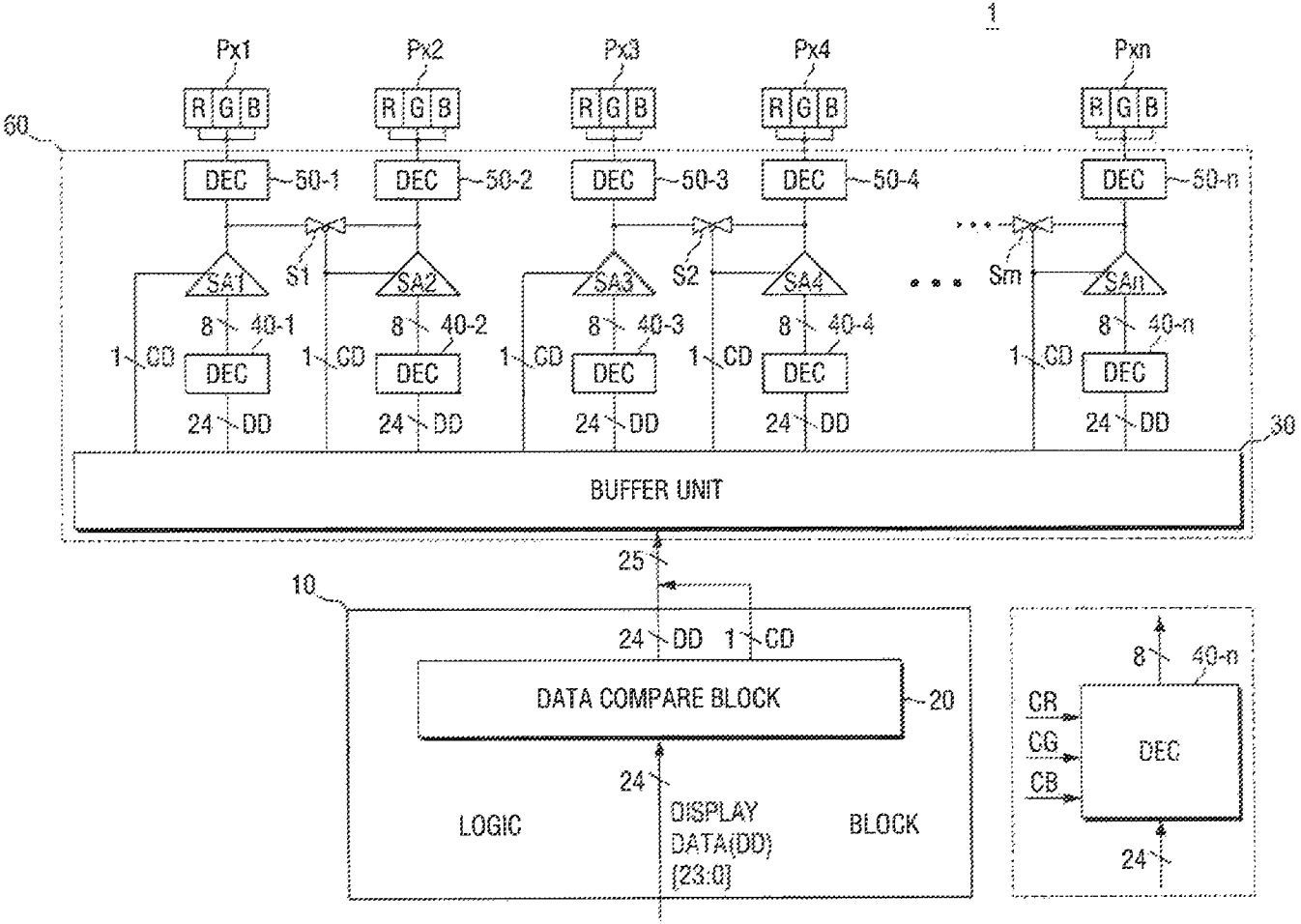
FIG. 1 is a block diagram of a display driving device according to an embodiment of the inventive concept.

FIG. 1 is a block diagram of a display driving device according to an embodiment of the inventive concept.

Referring to FIG. 1, the display driving device 1 is preferably implemented as a display drive integrated circuit (DDI) and includes a logic block 10 and a source driver 60.

The logic block 10 digitally processes externally input display data DD and supplies the same to the source driver 60. Thus, the logic block 10 includes digital circuits for digitally processing the externally input display data DD. In particular, in this embodiment, the logic block 10 includes a data compare block 20 that compares the externally input display data DD and generates control data CD. Thus, the data compare block 20 may be disposed in the logic block 10 and may be implemented using some of the digital circuits included in the logic block 10.

In some embodiments of the inventive concept, the data compare block 20 may compare data supplied to source amplifiers SA1 to SAn disposed to be adjacent to each other and may generate control data CD based on the comparison result.

For example, when first display data DD output through the first source amplifier SA1 and second display data DD output through the second source amplifier SA2 are different from each other, the data compare block 20 may generate first data as the control data CD. When third display data DD output through the third source amplifier SA3 and fourth display data DD output through the fourth source amplifier SA4 are the same as each other, the data compare block 20 may generate second data as the control data CD. Here, the first data generated as the control data CD may include, for example, logic level high data, and the second data may include, for example, logic level low data.

In more detail, when the first display data DD output through the first source amplifier SA1 and the second display data DD output through the second source amplifier SA2 are different from each other, the data compare block 20 may generate '1' as the control data CD. When the third display data DD output through the third source amplifier SA3 and the fourth display data DD output through the fourth source amplifier SA4 are the same as each other, the data compare block 20 may generate '0' as the control data CD. However, the inventive concept does not limit the example of the control data CD generated by the data compare block 20 to those listed herein, but the control data CD generated by the data compare block 20 may be modified in various manners.

Meanwhile, the above description has examined the example of cases where the first display data DD output through the first source amplifier SA1 and the second display data DD output through the second source amplifier SA2 are different from each other and where the third display data DD output through the third source amplifier SA3 and the fourth display data DD output through the fourth source amplifier SA4 are the same as each other. However, the data compare block 20 may also perform the same operation in cases reverse to those stated above. Thus, when the first display data DD output through the first source amplifier SA1 and the second display data DD output through the second source amplifier SA2 are the same as each other, the data compare block 20 may generate '0' as the control data CD. When the third display data DD output through the third source amplifier SA3 and the fourth display data DD output through the fourth source amplifier SA4 are different from each other, the data compare block 20 may generate '1' as the control data CD.

The display data DD externally applied to the data compare block 20 may be supplied in serialized forms. In some embodiments of the inventive concept, 24-bit data may be required to operate one among pixels Px1 to Pxn. In such a manner, the 24-bit data required to operate one among pixels Px1 to Px may be grouped by the data required to operate each pixel to then be supplied to the data compare block 20. Thus, the 24-bit data required to operate the first pixel Px1 is serialized to then be supplied to the data compare block 20, and the 24-bit data required to operate the second pixel Px2 is also serialized to then be supplied to the data compare block 20.

The data compare block 20 may receive the serialized 24-bit display data DD and may add the aforementioned control data CD thereto. For example, the data compare block 20 may compare the 24-bit display data DD required to operate the first pixel Px1 with the 24-bit display data DD required to operate the second pixel Px2. As the comparison result, if the display data DD required to operate the first pixel Px1 is different from the display data DD required to operate the second pixel Px2, the data compare block 20 may generate first data as the control data CD and may incorporate the first data into the 24-bit display data DD required to operate the second pixel Px2 to then be supplied to the buffer unit 30. In addition, the data compare block 20 may compare the 24-bit display data DD required to operate the first pixel Px1 with the 24-bit display data DD required to operate the second pixel Px2. As the comparison result, if the display data DD required to operate the first pixel Px1 is the same as the 24-bit display data DD required to operate the second pixel Px2, the data compare block 20 may generate second data as the control data CD and may incorporate the second data into the 24-bit display data DD required to operate the second pixel Px2 to then be supplied to the buffer unit 30. Accordingly, the data output from the data compare block 20 may be serial data grouped in units of 25 bits (24 bits of display data DD+1 bit of control data CD).

In some embodiments of the inventive concept, the data compare block 20 may generate control data CD to be supplied to the source amplifiers SA1 to SAn disposed to be adjacent to each other in different manners. In some embodiments of the inventive concept, the data compare block 20 may generate the control data CD to be supplied to a source amplifier (e.g., SA(n−1)) disposed on an odd-numbered column and the control data CD to be supplied to a source amplifier (e.g., SA2*n*) disposed on an even-numbered column in different manners. For example, the data compare block 20 may always generate the first data as the control data CD to be supplied to a source amplifier (e.g., SA(n−1)) disposed on an odd-numbered column, and may generate the control data CD to be supplied to a source amplifier (e.g., SA2*n*) disposed on an even-numbered column in such a manner as described above.

The data compare block 20 may, for example, always generate the first data as the control data CD for the 24-bit display data DD required to operate the first pixel Px1. However, for the 24-bit display data DD required to operate the second pixel Px2 disposed to be adjacent to the first pixel Px1, the data compare block 20 may compare the 24-bit display data DD required to operate the second pixel Px2 with the 24-bit display data DD required to operate the first pixel Px1. If the 24-bit display data DD required to operate the second pixel Px2 is different from the 24-bit display data DD required to operate the first pixel Px1, the data compare block 20 may generate the first data as the control data CD. If the 24-bit display data DD required to operate the second pixel Px2 is the same as the 24-bit display data DD required to operate the first pixel Px1, the data compare block 20 may generate the second data as the control data CD.

The source driver 60 includes a buffer unit 30, a plurality of decoders 40-1 to **40-*n* and 50-1 to 50-*n*, and a plurality of source amplifiers SA1 to SAn. In some embodiments of the inventive concept, the source driver 60** may include analog circuits.

The buffer unit 30 receives the control data CD and the display data DD from the data compare block 20 and supplies the same to the source amplifiers SA1 to SAn at a predetermined time. Thus, the buffer unit 30 may buffer the display data DD and the control data CD supplied from the data compare block 20 in serialized forms and may then supply the same to the source amplifiers SA1 to SAn at a predetermined time. Accordingly, the display data DD and the control data CD, which are serialized and then supplied to the buffer unit 30 may be parallelized to then be supplied to the source amplifiers SA1 to SAn.

In some embodiments of the inventive concept, in order to perform the functions, the buffer unit 30 may be constituted by a plurality of shift registers, which will now be described in more detail with reference to FIG. 2.

Figure 2:
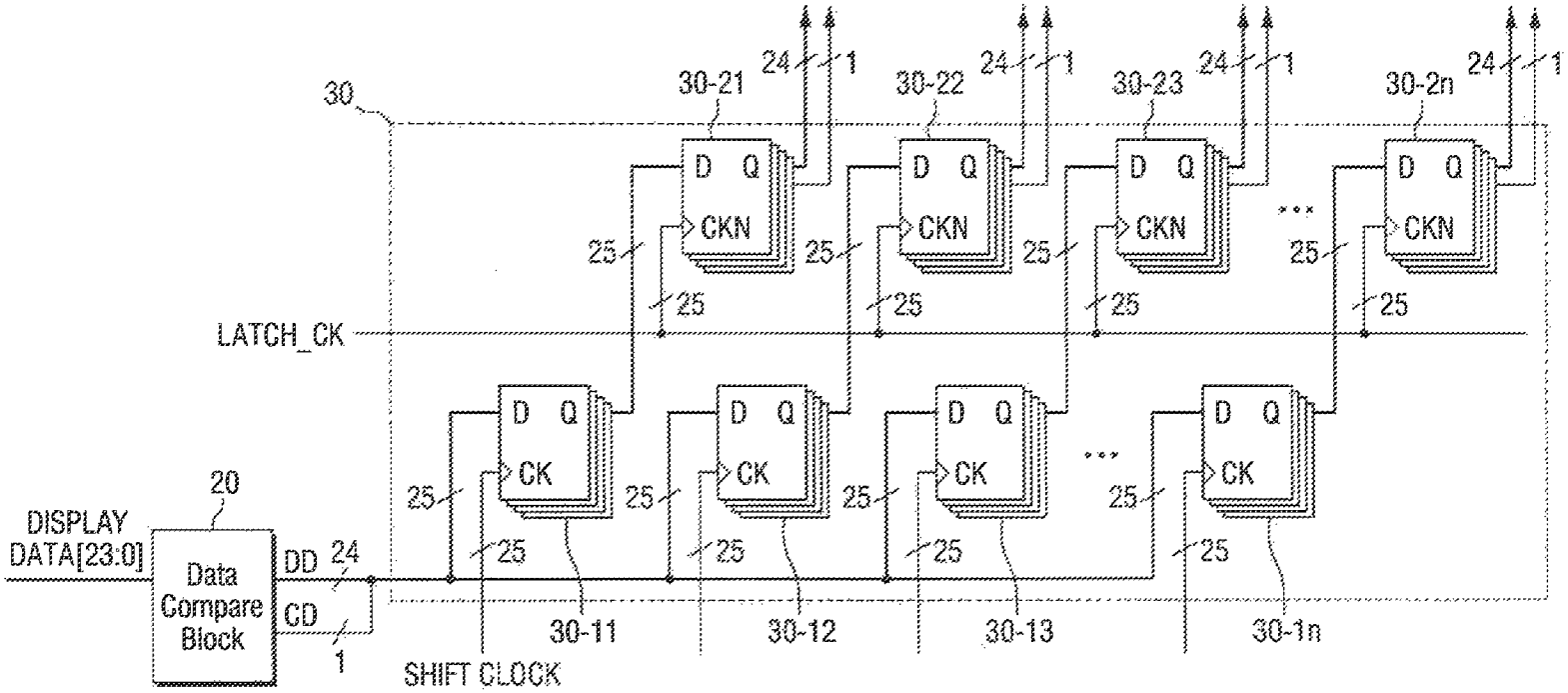
FIG. 2 is an exemplary detailed block diagram of a buffer unit shown in FIG. 1.

FIG. 2 is an exemplary detailed block diagram of a buffer unit shown in FIG. 1.

Referring to FIG. 2, the buffer unit 30 includes first shift registers 30-11 to **30-1*n* and second shift registers 30-21 to 30-2*n***.

The first shift registers 30-11 to **30-1*n* parallelize serialized 25-bit data supplied from the data compare block 20. The first shift registers 30-11 to 30-1*n* include a plurality of (e.g., 25) shift registers. As shown, the first shift registers 30-11 to 30-1*n*** may be synchronized with shift clocks to then parallelize the serialized 25-bit data.

The second shift registers 30-21 to **30-2*n* latch parallelized 25-bit data output from the first shift registers 30-11 to 30-1*n* and output the latched data at a predetermined time. The second shift registers 30-21 to 30-2*n*** also include a plurality of (e.g., 25) shift registers, and may simultaneously the latched data when a latch clock LATCH_CK is applied.

FIG. 2 shows that the display data DD includes 24 bit data, and its control data CD includes 1 bit data, but the inventive concept is not limited thereto. For example, when the display data DD includes 48 (e.g., 16+16+16) bits, and the control data CD includes 1 bit, the buffer unit 30 may be the configured differently. When the display data DD includes 48 bits and its control data CD includes 1 bit, each of the first and second shift registers 30-11 to **30-1*n* and 30-21~30-2*n* includes 49 shift registers, unlike in FIG. 2**.

Referring back to FIG. 1, the 24-bit display data DD output from the buffer unit 30 is supplied to the first decoders 40-1 to **40-*n*. In addition, the respective first decoders 40-1 to 40-*n* decode the 24-bit display data DD supplied according to first to third control signals CR, CG and CB into 8-bit first (R), second (G) and third (B) subpixel data, respectively. For example, when the first control signal CR is supplied to the first decoders 40-1 to 40-*n*, the first decoders 40-1 to 40-*n* supply 8-bit first subpixel data running ahead among 24-bit display data DD to the source amplifiers SA1 to SAn. Next, when the second control signal CG is supplied to the first decoders 40-1 to 40-*n*, the first decoders 40-1 to 40-*n* supply 8-bit second subpixel data running next among the 24-bit display data DD to the source amplifiers SA1 to SAn. Finally, when the third control signal CB is supplied to the first decoders 40-1 to 40-*n*, the first decoders 40-1 to 40-*n* supply the last 8-bit third subpixel data among the 24-bit display data DD to the source amplifiers SA1** to SAn.

Here, the respective 8-bit subpixel data may be data required to operate three dots constituting each of pixels Px1 to Pxn. Thus, the 8-bit first subpixel data decoded by the first control signal CR and output may be converted into a first subpixel voltage through the source amplifiers SA1 to SAn to then be supplied to a first dot R of each of pixels Px1 to Pxn. Next, the 8-bit first subpixel data decoded by the second control signal CG and output may be converted into a second subpixel voltage through the source amplifiers SA1 to SAn to then be supplied to a second dot G of each of pixels Px1 to Pxn. Finally, the 8-bit first subpixel data decoded by the third control signal CB and output may be converted into a third subpixel voltage through the source amplifiers SA1 to SAn to then be supplied to a third dot B of each of pixels Px1 to Pxn.

Meanwhile, the 1-bit control data CD output from the buffer unit 30 is supplied to the respective source amplifiers SA1 to SAn. In addition, the control data CD supplied to the source amplifier SA(n−1) disposed on an odd-numbered column may is supplied to a plurality of switches S1 to Sm, as shown in FIG. 1. Here, when the control data CD is, for example, first data that is logic level high, it enables each of the source amplifiers SA1 to SAn and turns OFF each of the plurality of switches S1 to Sm. Conversely, when the control data CD is, for example, second data that is logic level low, it disables each of the source amplifiers SA1 to SAn and turns ON each of the plurality of switches S1 to Sm. The operation of the display driving device 1 according to the embodiment of the inventive concept will later be described in more detail.

In an exemplary embodiment, the first decoders 40-1 to **40-*n*** are implemented through first to third decoding switches turned ON/OFF by the first to third control signals CR, CG and CB, but the inventive concept is not limited thereto.

The respective source amplifiers SA1 to SAn include a plurality of stages for performing different processes on an input signal based on the received display data DD and then outputting pixel voltages corresponding to the received display data DD.

Hereinafter, configurations of the source amplifiers SA1 to SAn will be described in more detail with reference to FIGS. 3 and 4.

Figure 3:
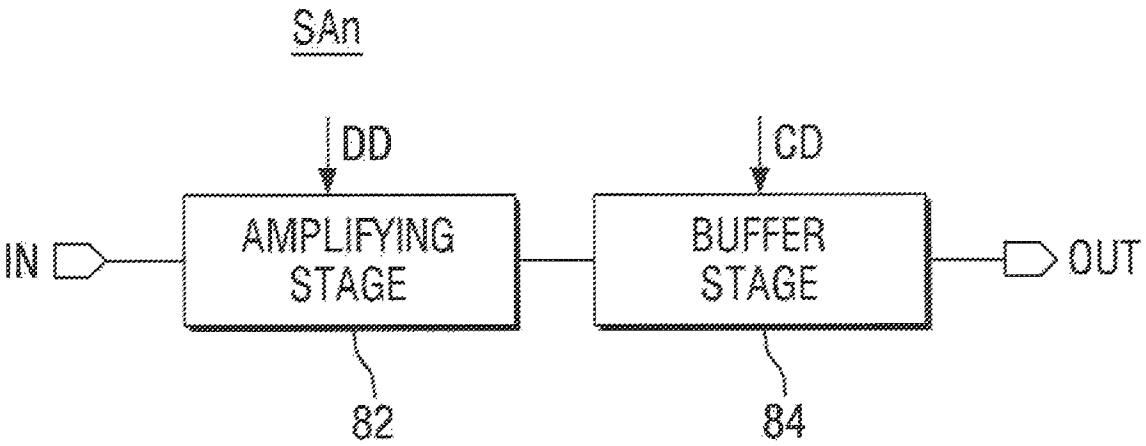
FIG. 3 is an exemplary detailed block diagram of a source amplifier shown in FIG. 1.
Figure 4:
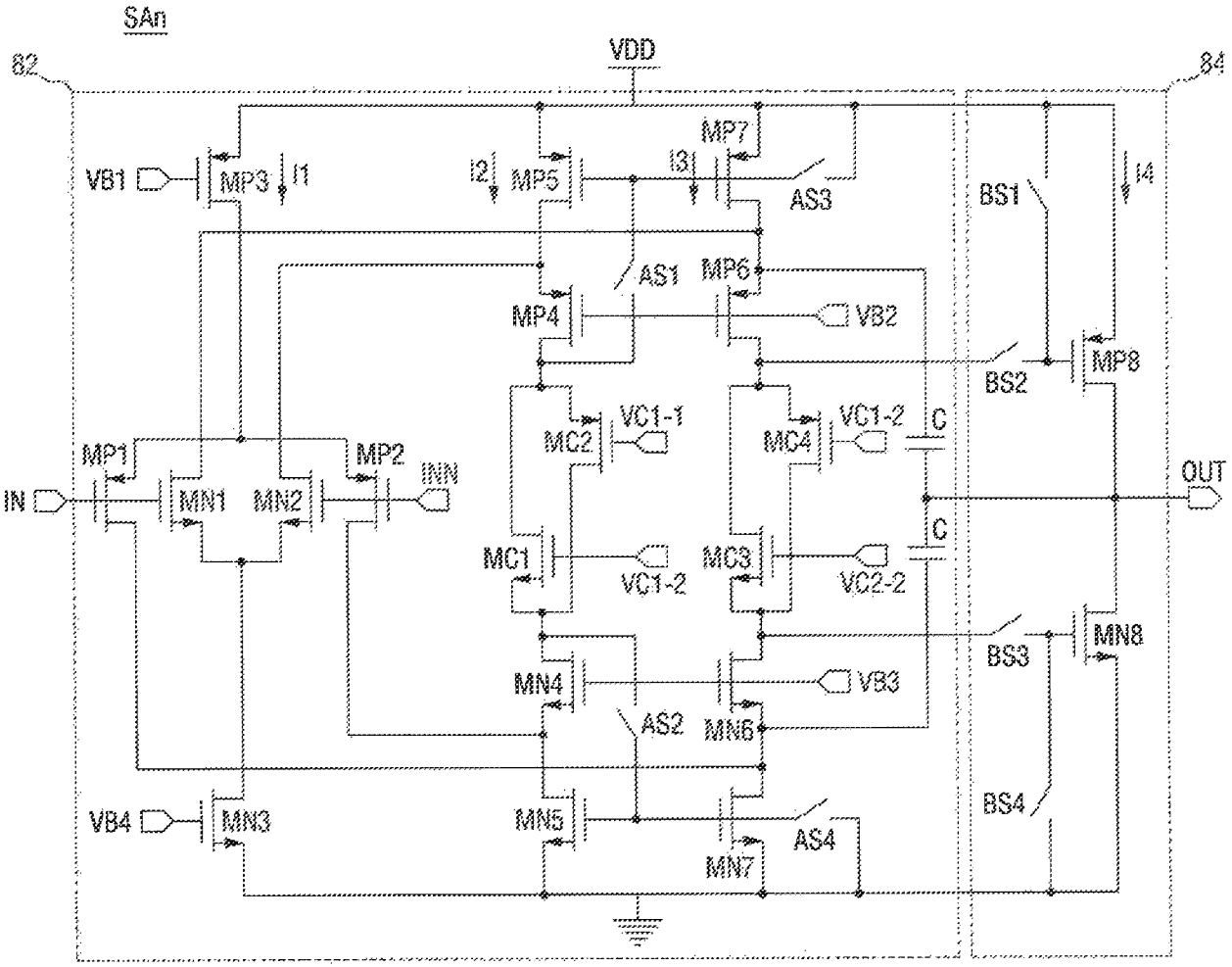
FIG. 4 is a detailed circuit diagram of the source amplifier shown in FIG. 3.

FIG. 3 is an exemplary detailed block diagram of a source amplifier shown in FIG. 1 and FIG. 4 is a detailed circuit diagram of the source amplifier shown in FIG. 3.

Referring to FIGS. 3 and 4, the source amplifier SAn has a first stage in which a first process is performed on an input signal input to an input terminal IN based on the received display data and a second stage in which a second process is performed on the first processed input signal. In some embodiments of the inventive concept, the first stage for performing the first process may be an amplifying stage 82 for amplifying the input signal according to the received display data DD, and the second stage for performing the second first process may be a buffering stage 84 for buffering the amplified input signal.

While the first control signal CR is applied to the decoders (40-1~**40-*n* and 50-1~50-*n* of FIG. 1), the input signal input to the input terminal IN is amplified according to the first subpixel data received from the buffer unit (30 of FIG. 1) in the amplifying stage 82 and is buffered to then be output as a first subpixel voltage in the buffer stage 84. Similarly, while the second control signal CG is applied to the decoders (40-1~40-*n* and 50-1~50-*n* of FIG. 1), the input signal input to the input terminal IN is amplified according to the second subpixel data received from the buffer unit (30 of FIG. 1) in the amplifying stage 82 and is buffered to then be output as a second subpixel voltage in the buffer stage 84. Similarly, while the third control signal CB is applied to the decoders (40-1~40-*n* and 50-1~50-*n* of FIG. 1), the input signal input to the input terminal IN is amplified according to the third subpixel data received from the buffer unit (30 of FIG. 1) in the amplifying stage 82 and is buffered to then be output as a third subpixel voltage in the buffer stage 84**.

FIG. 4 illustrates that the amplifying stage 82 according to an exemplary embodiment of the inventive concept includes first to seventh NMOS transistors MN1 to MN7, first to seventh PMOS transistors MP1 to MP7, and first to fourth control transistors MC1 to MC4, but the inventive concept is not limited thereto. As the amplifying stage 82 illustrated in FIG. 4, first to third currents I1 to I3 flowing from a power terminal VDD to a ground terminal are determined according to the display data DD received from the buffer unit (30 of FIG. 1), thereby amplifying the input signal input to an input terminal IN.

Meanwhile, in some embodiments of the inventive concept, the amplifying stage 82 includes first to fourth amplifying switches AS1 to AS4, as shown in FIG. 4. Here, the first to fourth amplifying switches AS1 to AS4 may be turned ON/OFF, irrespective of the control data CD output from the buffer unit (30 of FIG. 1). Thus, the control data CD output from the buffer unit (30 of FIG. 1) may not affect an ON/OFF state of the first to fourth amplifying switches AS1 to AS4 included in the amplifying stage 82. For example, in some embodiments of the inventive concept, the first to fourth amplifying switches AS1 to AS4 included in the amplifying stage 82 may be always in ON state irrespective of the control data CD output from the buffer unit (30 of FIG. 1). In some embodiments of the inventive concept, the first to fourth amplifying switches AS1 to AS4 may be omitted. In this case, the amplifying stage 82 of the source amplifier SAn may be always enabled irrespective of the control data CD output from the buffer unit (30 of FIG. 1). Thus, the first to third currents I1 to I3 may always flow from the power terminal VDD to the ground terminal whenever the display data DD is applied.

Meanwhile, the control data CD output from the buffer unit (30 of FIG. 1) is supplied to the buffer stage 84. Thus, the control data CD output from the buffer unit (30 of FIG. 1) may not affect whether to enable or not enable the amplifying stage 82 of the source amplifier SAn, but may be used to enable or to disable the buffer stage 84.

The buffer stage 84 may include, for example, an eighth PMOS transistor MP8 and an eighth NMOS transistor MN8. The buffer stage 84 may also include first to fourth buffer switches BS1 to BS4. Here, the first to fourth buffer switches BS1 to BS4 are connected to gates of the eighth PMOS transistor MP8 and the eighth NMOS transistor MN8, and are turned ON/OFF according to the control data CD output from the buffer unit (30 of FIG. 1).

When the control data CD output from the buffer unit (30 of FIG. 1) is first data (e.g., logic level high data), the first to fourth buffer switches BS1 to BS4 are turned ON, respectively, and when the control data CD output from the buffer unit (30 of FIG. 1) is second data (e.g., logic level low), the first to fourth buffer switches BS1 to BS4 are turned OFF, respectively. Thus, when the control data CD output from the buffer unit (30 of FIG. 1) is first data (e.g., logic level high data), the buffer stage 84 is enabled, and when the control data CD output from the buffer unit (30 of FIG. 1) is second data (e.g., logic level low data), the buffer stage 84 is disabled. Thus, when the buffer stage 84 is enabled, a fourth current I4 flows from the power terminal VDD to the ground terminal. However, when the buffer stage 84 is disabled, the fourth current I4 does not flow from the power terminal VDD to the ground terminal.

FIG. 4 illustrates an exemplary configuration of the buffer stage 84 including a pair of transistors MP8 and MN8 and four switches BS1 to BS4, but the inventive concept is not limited thereto. The buffer stage 84 may have various other configurations as long as it is capable of buffering a signal output from the amplifying stage 82.

Referring back to FIG. 1, the first to third subpixel voltages output from the respective source amplifiers SA1 to SAn are supplied to the second decoders 50-1 to **50-*n*. Like the first decoders 40-1 to 40-*n*, the second decoders 50-1 to 50-*n* decode pixel voltages applied to the second decoders 50-1 to 50-*n***.

The second decoders 50-1 to **50-*n* decode the first to third subpixel voltages output from the respective source amplifiers SA1 to SAn according to the first to third control signals CR, CG and CB and supply the decoded signals to each of the pixels Px1 to Pxn. If the first control signal CR is applied to the second decoders 50-1 to 50-*n*, the second decoders 50-1 to 50-*n* supply the first subpixel data output from the respective source amplifiers SA1 to SAn to the first dot R of each of the pixels Px1 to Pxn. Next, if the second control signal CG is applied to the second decoders 50-1 to 50-*n*, the second decoders 50-1 to 50-*n* supply the second subpixel data output from the respective source amplifiers SA1 to SAn to the second dot G of each of the pixels Px1 to Pxn. Finally, if the third control signal CB is applied to the second decoders 50-1 to 50-*n*, the second decoders 50-1 to 50-*n* supply the third subpixel data output from the respective source amplifiers SA1 to SAn to the third dot B of each of the pixels Px1** to Pxn.

In an exemplary embodiment, the second decoders 50-1 to **50-*n*** may also be implemented through the first to third decoding switches turned ON/OFF by the first to third control signals CR, CG and CB, but the inventive concept is not limited thereto.

Figure 5:
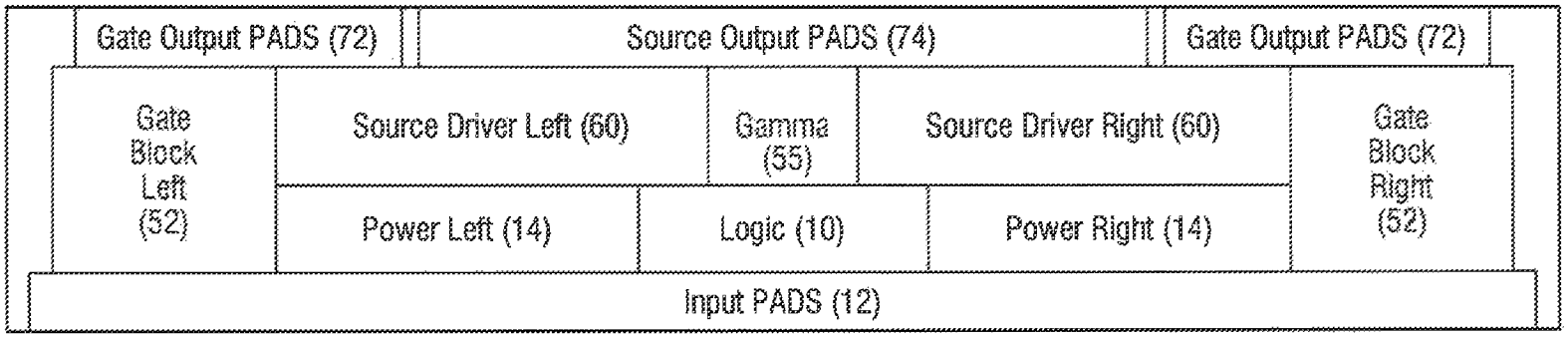
FIG. 5 is an plan view of the display driving device according to an embodiment of the inventive concept.

FIG. 5 is an plan view of the display driving device according to an embodiment of the inventive concept.

Referring to FIG. 5, an input pad 12 is disposed at a bottom end of the display driving device 1 to transfer the externally applied display data (DD of FIG. 1) to the logic block 10. As shown in FIG. 5, the input pad 12 is disposed to extend along the long side of the bottom end of the display driving device 1.

The logic block 10 is disposed at a top end of the input pad 12 to be adjacent to the input pad 12, and power blocks 14 are disposed in left and right sides of the logic block 10. The power blocks 14 are blocks for regulating the power required to operate the display driving device 1. Gate blocks 52 are disposed at exterior sides of the power blocks 14. A gate driver (not shown) may be disposed in each of the gate blocks 52 to generate a gate driving signal to be supplied to a plurality of gate lines disposed on a panel.

A gamma correction circuit 55 is disposed at a top end of the logic block 10. The gamma correction circuit 55 is a circuit for performing gamma correction to allow each of the pixels Px1 to Pxn included in the panel to fully reproduce a color. The source drivers 60 are disposed at opposite sides of the gamma correction circuit 55. The source drivers 60 are disposed to be adjacent to the logic block 10. Meanwhile, as described in an exemplary embodiment of the inventive concept, the data compare block 20 is not disposed in the source drivers 60 but may be disposed in the logic block 10. The logic block 10 may include an output terminal through which the control data (CD of FIG. 1) is output, and the source drivers 60 may receive the control data (CD of FIG. 1) generated from the logic block 10.

Figure 6:
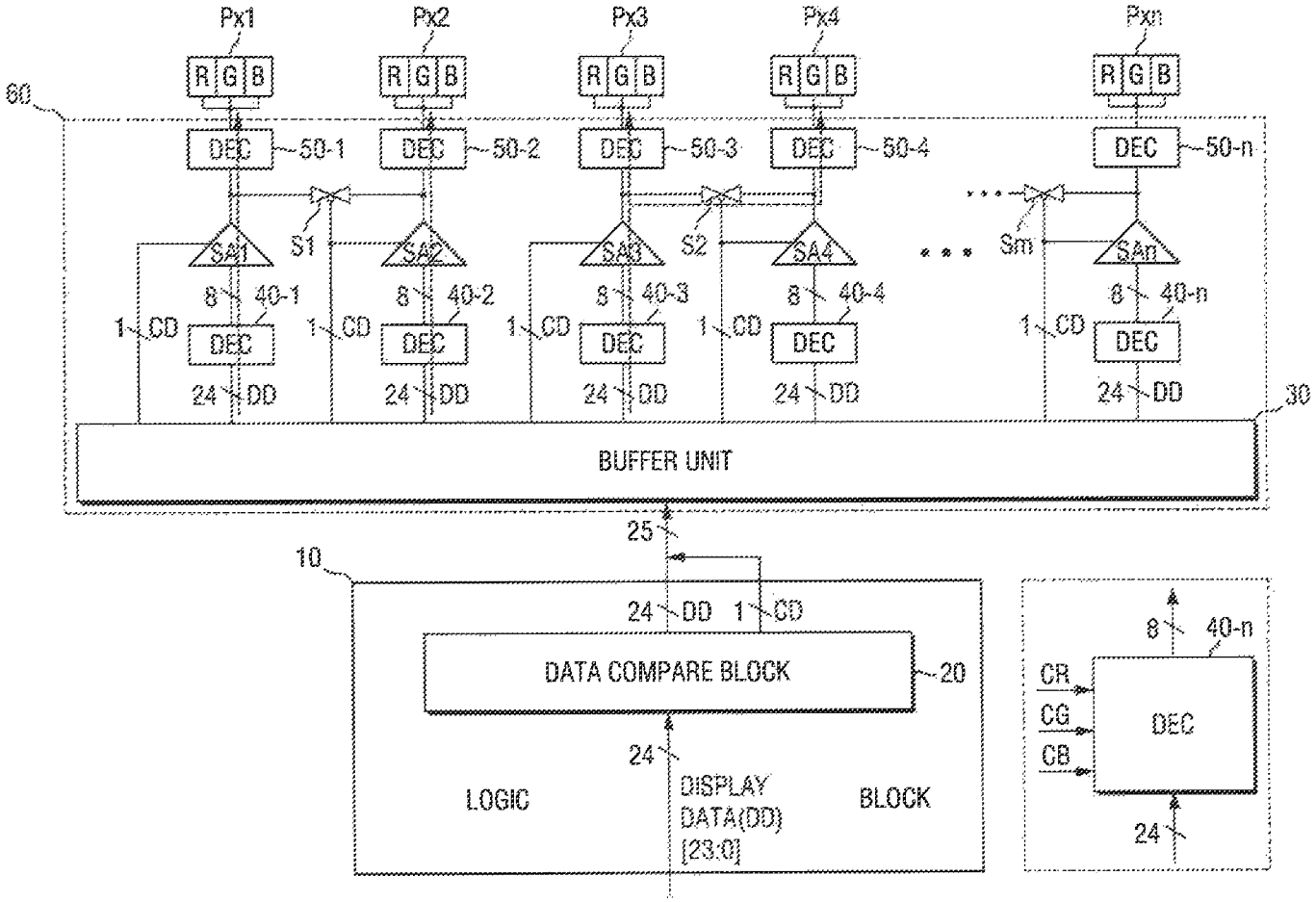
FIGS. 6 to 8 illustrate a method for operating the display driving device according to an embodiment of the inventive concept.

Source output pads 74 for outputting pixel voltages generated from the source drivers 60 and gate output pads 72 for outputting gate driving signals generated from the gate blocks 52 are disposed at upper ends of the source drivers 60 and the gate blocks 52. As shown in FIG. 6, the source output pads 74 are disposed to extend along the long side of the display driving device 1 to be adjacent to the source drivers 60. The gate output pads 72 are be disposed to extend along the long side of the top end of the display driving device 1 to be adjacent to the gate blocks 52.

Hereinafter, a method for operating the display driving device according to an embodiment of the inventive concept will be described with reference to FIGS. 6 to 8.

Figure 7:
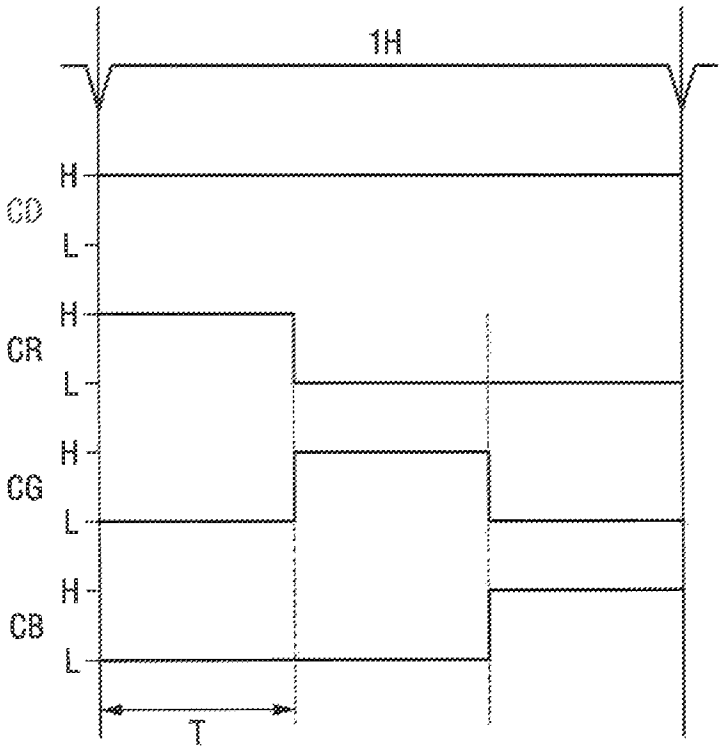
Figure 8:
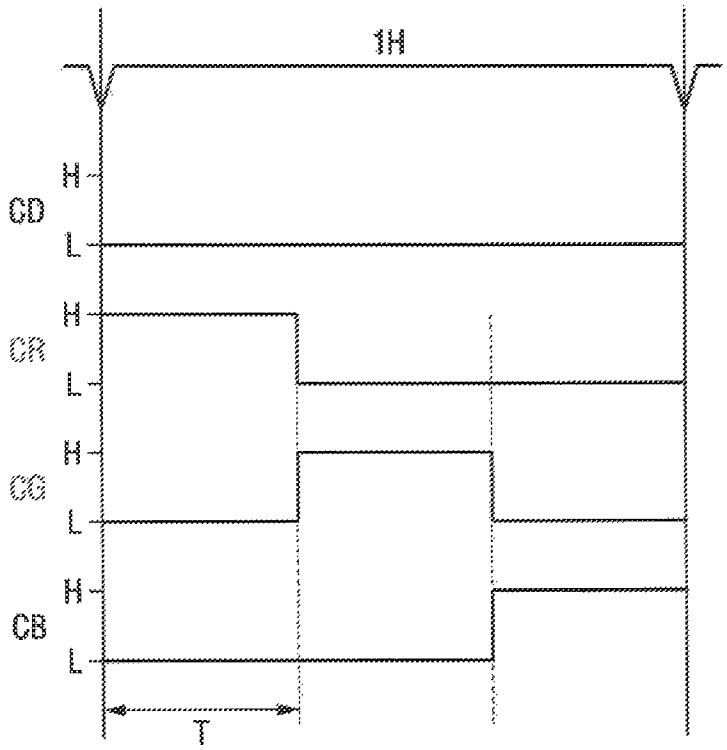

FIGS. 6 to 8 illustrate a method for operating the display driving device according to an embodiment of the inventive concept. FIG. 6 is the circuit diagram of the display driving device of FIG. 1 including data paths for illustrating an operating method thereof.

For the sake of convenient explanation in following description, it will be assumed that display data DD for operating the first and second pixels Px1 and Px2 adjacent to each other are different data and that display data DD for operating the third and fourth pixels Px3 and Px4 are the same as each other.

Referring first to FIG. 6, if the display data DD for operating the first pixel Px1 is externally applied to the data compare block 20 disposed in the logic block 10, the data compare block 20 generates first data (e.g., logic level high data) as the control data CD and supplies the first data to the buffer unit 30 together with display data DD.

Next, if the display data DD for operating the second pixel Px2 is externally applied to the data compare block 20 disposed in the logic block 10, the data compare block 20 compares the display data DD for operating the second pixel Px2 with the display data DD for operating the first pixel Px1. If, as assumed above, the display data DD for operating the first and second pixels Px1 and Px2 adjacent to each other are different from each other, then the data compare block 20 generates the first data (e.g., logic level high data) as the control data CD and supplies the first data to the buffer unit 30 together with display data DD.

Next, if the display data DD for operating the third pixel Px3 is externally applied to the data compare block 20 disposed in the logic block 10, the data compare block 20 generates the first data (e.g., logic level high data) as the control data CD and supplies the first data to the buffer unit 30 together with the display data DD.

Next, if the display data DD for operating the fourth pixel Px4 is externally applied to the data compare block 20 disposed in the logic block 10, the data compare block 20 compares the display data DD for operating the fourth pixel Px4 with the display data DD for operating the third pixel Px3. If as assumed above, the display data DD for operating the third and fourth pixels Px3 and Px4 adjacent to each other are the same as each other, then the data compare block 20 generates second data (e.g., logic level low data) as the control data CD and supplies the second data to the buffer unit 30 together with the display data DD.

Meanwhile, the buffer unit 30 sequentially latches the received display data DD and control data CD and simultaneously outputs the latched data at a predetermined time (e.g., a time at which the latch clock LATCH_CK of FIG. 2 is applied). Here, the control data CD is directly applied to each of the source amplifiers SA1 to SAn to determine whether to enable or not enable each of the source amplifiers SA1 to SAn (specifically, whether to enable or not enable the buffer stage (84 of FIG. 3) of each of the source amplifiers SA1 to SAn), and the control data CD is also applied to each of the switches S1 to Sm connected between each of the source amplifiers SA1 to SAn to determine whether to turn ON/OFF each of the switches S1 to Sm. In addition, the display data DD is applied to the first decoders 40-1 to **40-*n* connected to the respective source amplifiers SA1 to SAn, and the first decoders 40-1 to 40-*n* separate the display data DD into first to third subpixel data according to the first to third control signals CR, CG and CB to then supply the same to the respective source amplifiers SA1** to SAn.

FIG. 7 is a timing diagram of signals in the display driving device FIG. 1 for illustrating the control data CD and the first to third control signals CR, CG and CB as applied to the first to third source amplifiers SA1 to SA3 and the first decoders 40-1 to 40-3 connected thereto for one horizontal period (1H), and FIG. 8 is a timing diagram of the same signals (the control data CD and the first to third control signals CR, CG and CB) as applied to the fourth source amplifier SA4 and the first decoder 40-1 connected thereto for one horizontal period (1H).

Referring to FIGS. 6 and 7, as assumed above, the control data CD supplied to the first to third source amplifiers SA1 to SA3) is first data (e.g., logic level high). Thus, the buffer stage (84 of FIG. 3) of each of the first to third source amplifiers SA1 to SA3 is enabled while the first to third control signals CR, CG and CB are applied to the first decoders 40-1 to 40-3. Accordingly, the first to third source amplifiers SA1 to SA3 output pixel voltages based on the received display data DD.

Meanwhile, referring to FIGS. 6 and 8, as assumed above, the control data CD supplied to the fourth source amplifier SA4 is second data (e.g., logic level low data). Thus, the buffer stage (84 of FIG. 3) of the fourth source amplifier SA4 is disabled while the first to third control signals CR, CG and CB are applied to the first decoders 40-1 to 40-3. Accordingly, the fourth source amplifier SA4 does not output a pixel voltage based on the received display data DD.

Meanwhile, since the control data CD supplied to the second source amplifier SA2 is first data (e.g., logic level high data), the first switch S1 is turned OFF. However, since the control data CD supplied to the fourth source amplifier SA4 is second data (e.g., logic level low data), the second switch S2 is turned ON. Accordingly, the pixel voltage output from the third source amplifier SA3 is supplied to the fourth pixel Px4 as well as the third pixel Px3.

As described above, it has been assumed that the display data DD for operating the third and fourth pixels Px3 and Px4 are the same as each other, the display data DD supplied to the third source amplifier SA3 and the fourth source amplifier SA4 are the same as each other. Accordingly, the pixel voltages output from the third source amplifier SA3 and the fourth source amplifier SA4 will also be the same as each other. Therefore, as shown, even when the fourth pixel Px4 is operated by the third source amplifier SA3, the same image may be eventually displayed on a panel, and unnecessary operation of the fourth source amplifier SA4 can be prevented in advance, thereby reducing power consumption of a display drive integrated circuit (DDI) in operating the panel.

Meanwhile, as the quality (resolution) of an output image increases, the amount of pixel voltages to be supplied for one frame is increases. Accordingly, the time corresponding to one horizontal period (1H) shown in FIGS. 7 and 8 is gradually reduced. In such a state in which the time corresponding to one horizontal period (1H) is gradually reduced, when the amplifying stage (82 of FIG. 3) and the buffer stage (84 of FIG. 3) of each of the source amplifiers SA1 to SAn are both enabled or disabled, the enable/disable speed of each of the source amplifiers SA1 to SAn may not be sensitive to a change in the horizontal period (1H).

Thus, when a first horizontal period (kH) is changed to a second horizontal period (k+1)H), the source amplifiers SA1 to SAn need to rapidly respond to the change to be enabled/disabled. However, a considerable time is required to enable the source amplifiers SA1 to SAn, and meanwhile an erroneous image may be displayed to a user. Therefore, in this embodiment, only the buffer stage (84 of FIG. 3) in which the operation is switched faster than in the amplifying stage (82 of FIG. 3) is enabled/disabled by the control data CD, thereby operating the display driving device in a more reliable manner even in the gradually shortened horizontal period (1H).

Alternatively, if this embodiment is modified such that the control data CD is generated by subpixel data (e.g., 8-bit display data), the one horizontal period (1H) is further reduced to a period (T of FIGS. 7 and 8) during which each of the control signals CR, CG and CB is applied. However, in this embodiment, since the respective source amplifiers SA1 to SAn are rapidly enabled/disabled even in a short period, the display driving device 1 can be operated in a reliable manner.

Figure 9:
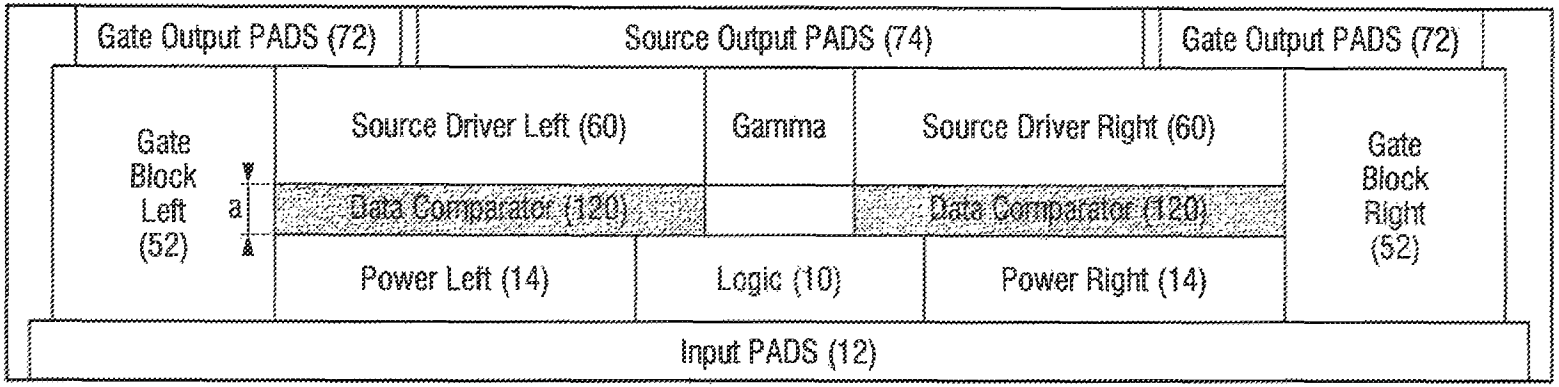
FIG. 9 is an plan view of a display driving device according to an embodiment of the inventive concept.

FIG. 9 is an plan view of a display driving device according to an embodiment of the inventive concept.

Referring to FIG. 9, unlike in the previously described display driving device (1 of FIG. 5), in the display driving device according to FIG. 9, the data compare block 120 is not disposed in the logic block 10 but is disposed in the source drivers 60 or is disposed separately from the logic block 10 and the source drivers 60.

Source output pads 74 for outputting pixel voltages generated from the source drivers 60 and gate output pads 72 for outputting gate driving signals generated from the gate blocks 52 are disposed at upper ends of the source drivers 60 and the gate blocks 52. As shown in FIG. 5, the source output pads 74 are disposed to extend along the long side of the display driving device 1 to be adjacent to the source drivers 60. The gate output pads 72 are be disposed to extend along the long side of the top end of the display driving device 1 to be adjacent to the gate blocks 52.

Hereinafter, a display driving device according to another embodiment of the inventive concept will be described with reference to FIGS. 10 and 11.

Figure 10:
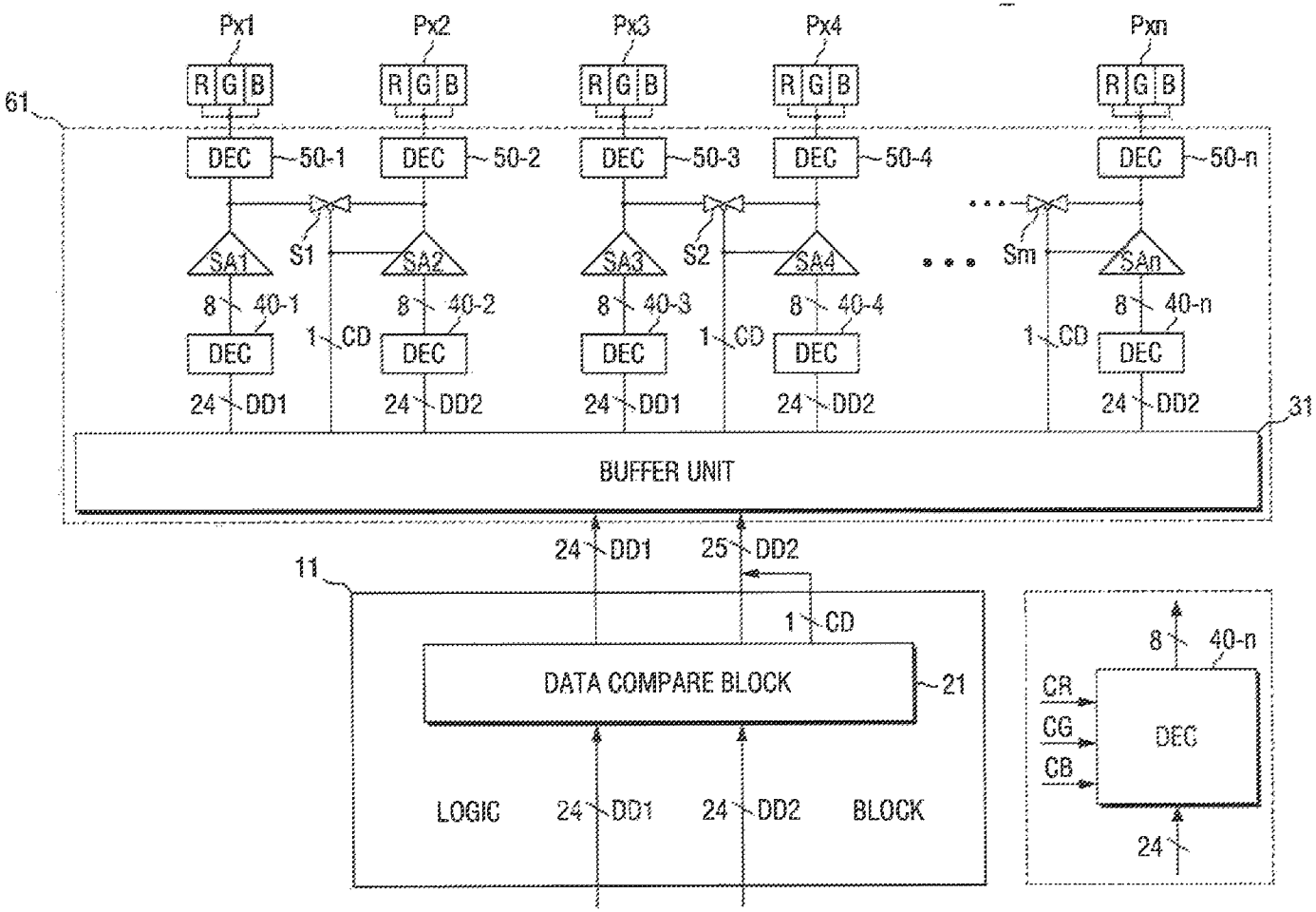
FIG. 10 is a block diagram of a display driving device according to an embodiment of the inventive concept.
Figure 11:
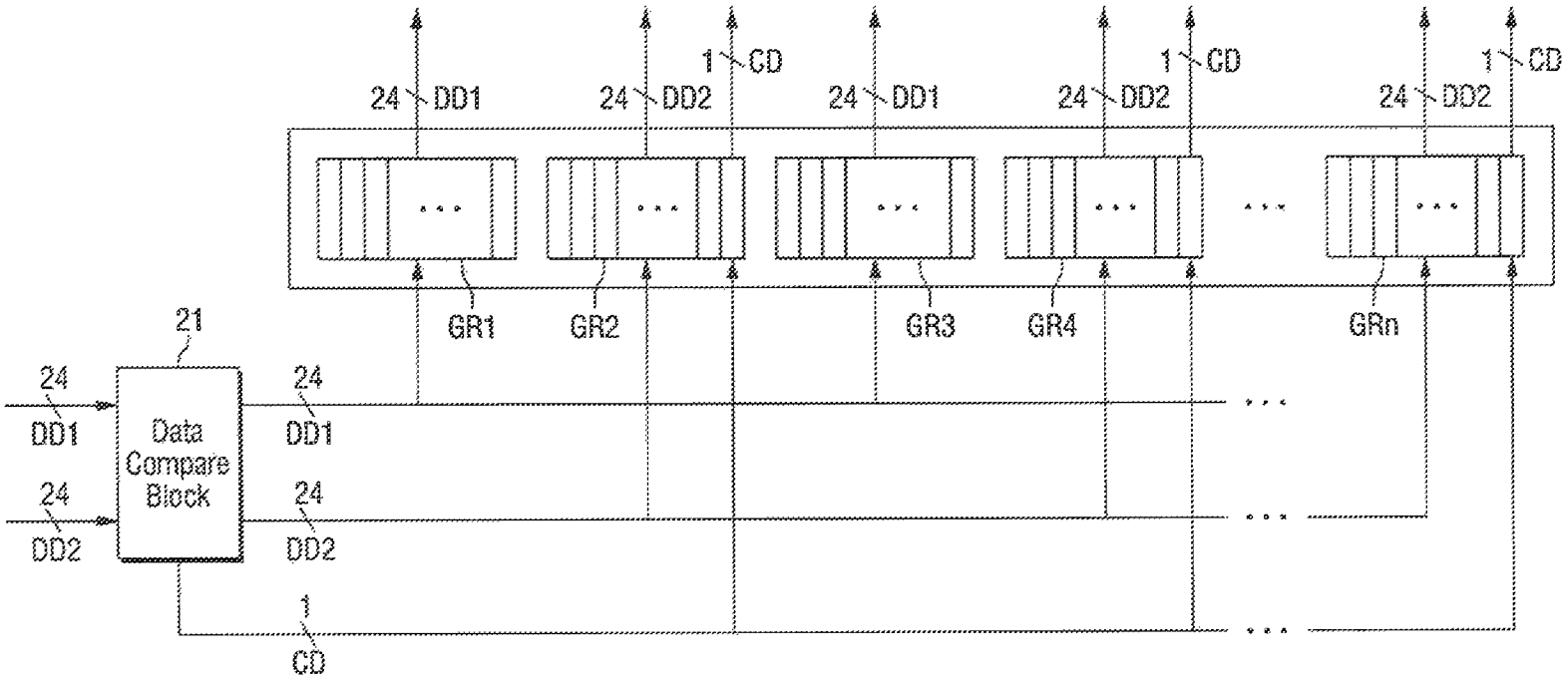
FIG. 11 is an exemplary detailed block diagram of a buffer unit shown in FIG. 10.

FIG. 10 is a block diagram of a display driving device according to an embodiment of the inventive concept and FIG. 11 is an exemplary detailed block diagram of the buffer unit shown in FIG. 10.

In the following description, redundant descriptions of the same or corresponding parts as those of the previous exemplary embodiment will be omitted and only the differences therebetween will be described herein.

Referring first to FIG. 10, the display driving device 2 includes a logic block 11 and a source driver 61.

The logic block 11 includes a data compare block 21 that compares externally input first display data DD1 and second display data DD2 with each other and generates control data CD based on the comparison result. Here, the data compare block 21 generates control data CD for the first display data DD1 to be supplied to a source amplifier SA(n−1) and a pixel Px(n−1), disposed on an odd-numbered column, but generates control data CD for the first display data DD1 or the second display data DD2 to be supplied to a source amplifier SAn and a pixel Pxn, disposed on an even-numbered column, based on the comparison result of the first display data DD1 and the second display data DD2.

In this embodiment, a buffer unit 31 included in the source driver 61 may include, for example, a plurality of graphic memories, to output serialized data received from the data compare block 21 as parallelized data at a predetermined time.

Referring to FIG. 11, the buffer unit 31 may include, for example, a second graphic memory GR(n−1) for storing and outputting the first display data DD1 to be supplied to the source amplifier SA(n−1) and the pixel Px(n−1), disposed on an odd-numbered column, and a second graphic memory GRn for storing and outputting the second display data DD2 and control data CD to be supplied to the source amplifier SAn and the pixel Pxn, disposed on an even-numbered column. Here, the second graphic memory GR(n−1) and the second graphic memory GRn may have different storage capacities. The storage capacity of the second graphic memory GRn may be greater than that of the second graphic memory GR(n−1).

In order to additionally store the control data CD, the storage capacity of the second graphic memory GRn needs to be greater than that of the second graphic memory GR(n−1). However, the storage capacity of the second graphic memory GRn needs not to be considerably greater than that of the second graphic memory GR(n−1). As shown in FIG. 11, the second graphic memory GRn additionally stores the control data CD of just 1 bit more than the graphic memory GR(n−1). Therefore, even if the display driving device 2 has the aforementioned configuration, an increase in the size of the buffer unit 31 may be negligible. Meanwhile, as described above with reference to FIG. 9, since the data compare block 21 is disposed within the logic block 10, the overall size of the display driving device 2 may be reduced. Therefore, even with this configuration, the overall size of the display driving device according to this embodiment can be reduced.

According to this embodiment, the control data CD supplied to the source amplifier SA(n−1) disposed on an odd-numbered column may be skipped, thereby designing circuit wirings in a more simplified manner. Accordingly, the manufacturing productivity can be improved.

Descriptions of the other components can be fully inferred by one skilled in the art based on the foregoing description of the aforementioned embodiments, and detailed descriptions thereof will be omitted.

Next, a display driving device according to an exemplary embodiment of the inventive concept will be described with reference to FIG. 12.

Figure 12:
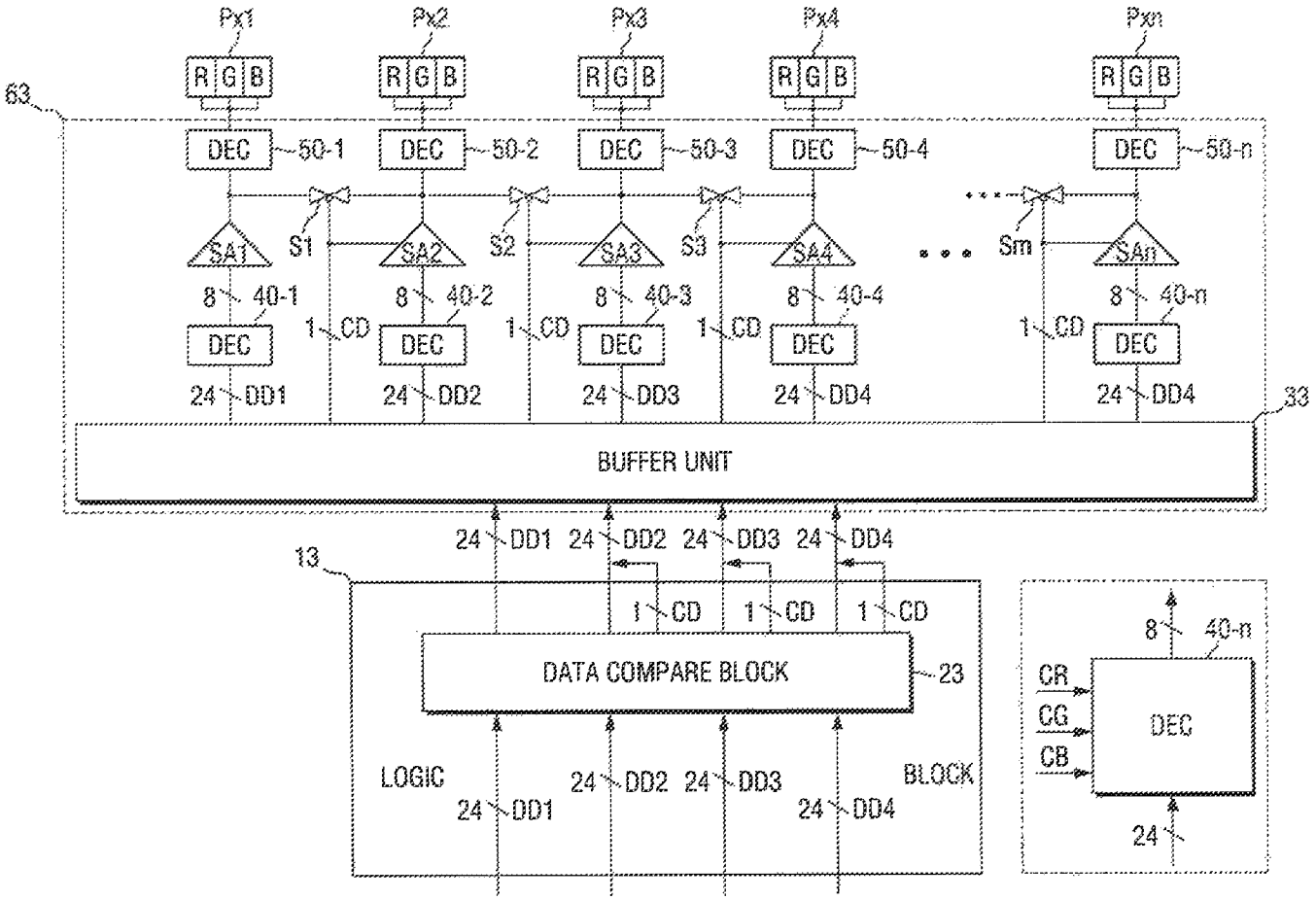
FIG. 12 is a block diagram of a display driving device according to an exemplary embodiment of the inventive concept.

FIG. 12 is a block diagram of a display driving device according to an exemplary embodiment of the inventive concept.

In the following description, redundant descriptions of the same or corresponding parts as those of the previous embodiment will be omitted and only differences therebetween will be described herein.

Referring to FIG. 12, the display driving device 3 according to an exemplary embodiment of the inventive concept includes a logic block 13 and a source driver 63.

The logic block 13 includes a data compare block 23 that compares externally input first to fourth display data DD to DD4 with one another and generates first to third control data CD1 to CD3 based on the comparison result. Here, the data compare block 23 does not generate first to third control data CD1 to CD3 for the first display data DD1. However, the data compare block 23 generates first control data CD1 for the second display data DD2 based on the comparison result of the first display data DD1 and the second display data DD2, and generates second control data CD2 for the third display data DD3 based on the comparison result of the first to third display data DD1 to DD3, and generates third control data CD2 for the fourth display data DD4 based on the comparison result of the first to fourth display data DD1 to DD4.

In this embodiment, a buffer unit 33 included in the source driver 63 outputs serialized data received from the data compare block 23 to source amplifiers SA1 to SA4 as parallelized data at a predetermined time.

Thus, in this embodiment, one source driver (e.g., a first source driver SA1) can operate up to 4 pixels Px1 to Px4 according to whether or not the first to fourth display data DD1 to DD4 are the same as each other.

Thus, for example, when the first to fourth display data DD1 to DD4 for operating the first to fourth pixels Px1 to Px4 are the same as each other, the first to fourth pixels Px to Px4 may be operated by the first source driver SA1. When the first to third display data DD1 to DD3 for operating the first to third pixels Px1 to Px3 are the same as each other but are different from the fourth display data DD4 for driving the fourth pixel Px4, the first to third pixels Px1 to Px3 may be operated by the first source driver SA1 and the fourth pixel Px4 may be operated by the fourth source driver SA4.

As described above, if the number of pixels that can be operated by one source driver (e.g., the first source driver SA1) is increased, the number of disabled source drivers (e.g., second to fourth source drivers SA2 to SA4) is also increased, thereby further reducing power consumption.

Descriptions of the other components can be fully inferred by one skilled in the art based on the foregoing description of the aforementioned embodiments, and detailed descriptions thereof will be omitted.

Figure 13:
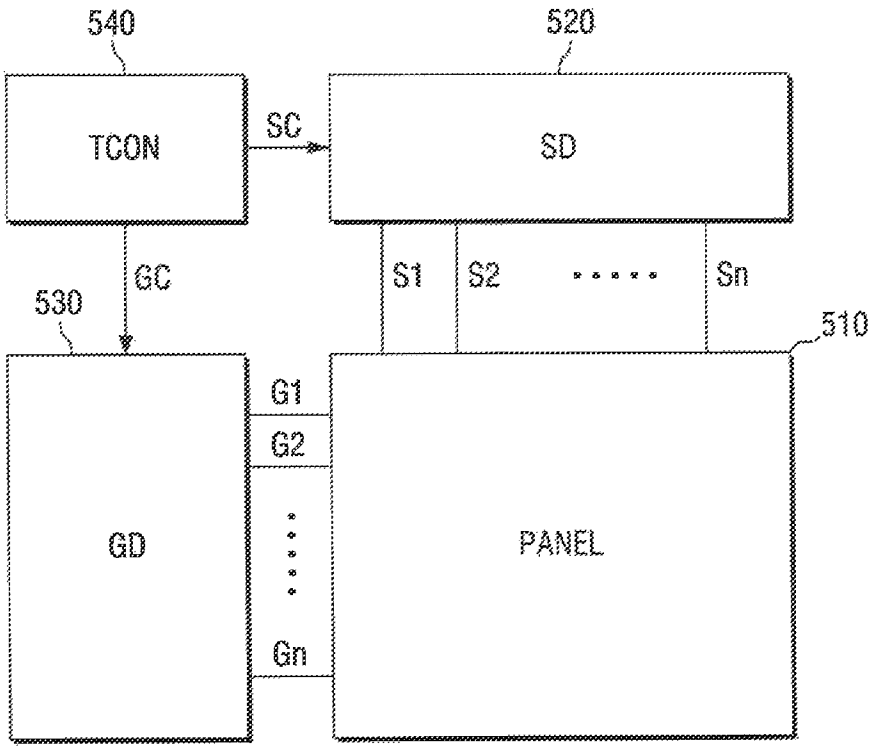
FIG. 13 is a block diagram of a display apparatus according to an exemplary embodiment of the inventive concept.

FIG. 13 is a block diagram of a display apparatus according to an exemplary embodiment of the inventive concept.

Referring to FIG. 13, the display apparatus 500 includes a panel 510, a source driver 520, a gate driver 530 and a timing controller 540.

The panel 510 includes a plurality of pixels. A plurality of gate lines G1 to Gn and a plurality of source lines S1 to Sn are arranged on the panel 510 to intersect each other in a matrix configuration, and intersections of the gate lines G1 to Gn and the source lines S1 to Sn are defined as pixels. Meanwhile, the respective pixels may include a plurality of dots (e.g., R, G and B subpixels), as described above.

The timing controller 540 controls the source driver 520 and the gate driver 530. The timing controller 540 receives a plurality of control signals and data signals from an external system (not shown). The timing controller 540 generates a gate control signal GC and a source control signal SC in response to the received plurality of control signals and data signals and outputs the gate control signal GC to the gate driver 530 and the source control signal SC to the source driver 520.

The gate driver 530 sequentially supplies gate driving signals to the panel 510 through the gate lines G1 to Gn in response to the gate control signal GC. In addition, the source driver 520 supplies a predetermined pixel voltage to the panel 510 through the source lines S1 to Sn in response to the source control signal SC whenever the gate lines G1 to Gn are sequentially selected.

Here, the source drivers 60, 61 or 63 included in one of the display driving devices 1 to 3 according to embodiments of the inventive concept may be used as the source driver 520. Accordingly, the display apparatus 500 according to the inventive concept can be operated with low power consumption, and the product size can also be reduced.

Next, an electronic system to which display driving devices in which to embodiments of the inventive concept can be employed will be described with reference to FIG. 14.

Figure 14:
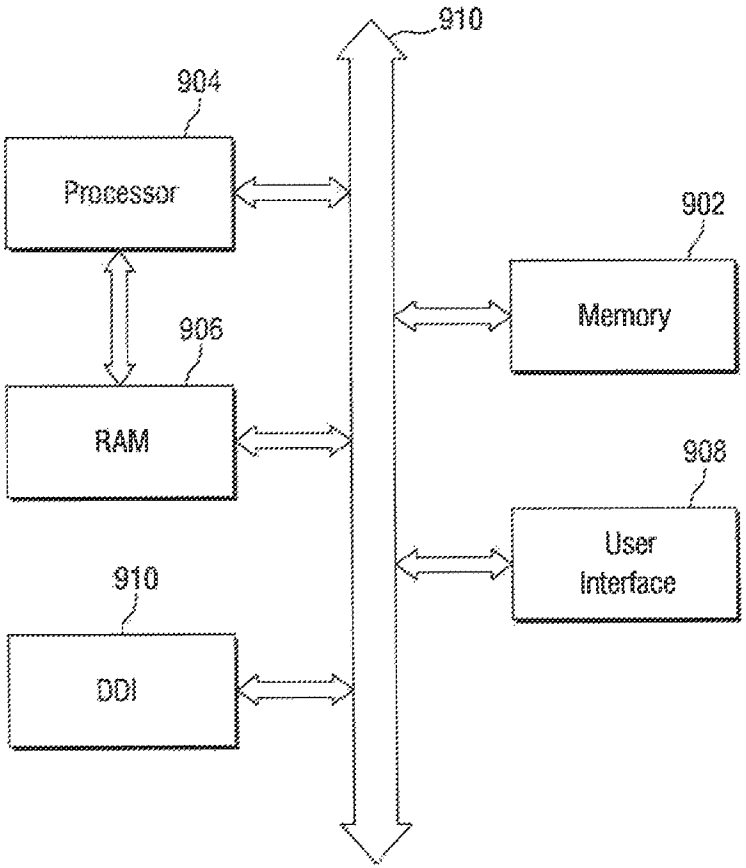
FIG. 14 is a block diagram of an electronic system in which a display driving device according to an embodiment of the inventive concept can be employed.

FIG. 14 is a block diagram of an electronic system in which a display driving device according to an embodiment of the inventive concept can be employed.

Referring to FIG. 14, the electronic system 900 includes a memory system 902, a processor 904, a RAM 906, a user interface 908, and a display driving device 910.

The memory system 902, the processor 904, the RAM 906, the user interface 908, and the display driving device 910 may perform data communication with each other through a bus 910.

The processor 904 executes a program and controls the electronic system 900. The processor 904 includes at least one of a microprocessor, a digital signal processor, a microcontroller, and logic elements capable of functions similar to those of these elements.

The RAM 906 may be used as an operating memory of the processor 904. The RAM 906 may include, for example, a volatile memory such as DRAM. The processor 904 and the RAM 906 may be packaged into a semiconductor device or a semiconductor package.

The user interface 908 may be used to input/output data to/from the electronic system 900. Examples of the user interface 908 may include a key pad, a key board, an image sensor, a display device, and so on. When the electronic system 900 is a system associated with image display, the image processed in the electronic system 900 and output from the electronic system 900 may be shown to a user by displaying the same on the panel (510 of FIG. 13) through the display driving device 910.

The memory system 902 can store executable code for the operation of the processor 904, data processed by the processor 904 or externally input data. The memory system 902 may include a separate controller for driving the same, and may also be configured to additionally include an error correction block. The error correction block may be configured to detect and correct errors of the data stored in the memory system 902 using an error correction code (ECC).

In an information processing system, such as a mobile device or a desktop computer, a flash memory may be mounted as the memory system 902. The flash memory may be or include a solid state drive (SSD). In this case, the electronic system 900 may stably store large capacity data in the flash memory.

The memory system 912 may be integrated into a single semiconductor substrate. As an example, the memory system 912 may be integrated as one semiconductor device to implement a memory card. The controller and the memory device may be integrated as one semiconductor device to implement a PC card (for example, PCMCIA), a compact flash card (CF), a smart media card (SM/SMC), a memory stick, a multimedia card (for example, MMC, RS-MMC and MMCmicro), an SD card (for example, SD, miniSD and microSD), and a universal flash memory device (for example, UFS).

One of the aforementioned display driving devices 1 to 3 according to embodiments of the inventive concept may be employed as the display driving device 910.

Figure 15:
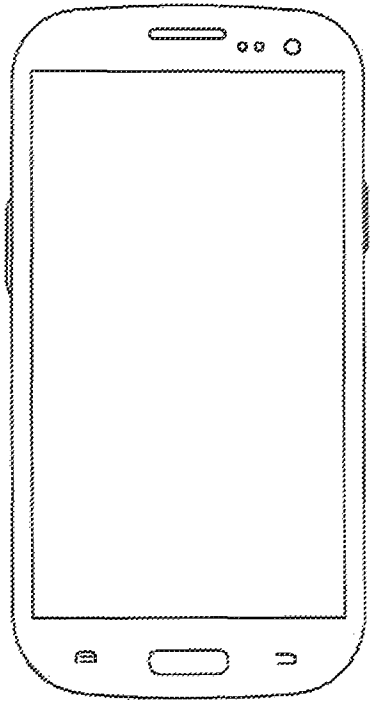
FIG. 15 illustrates an application example of the electronic system shown in FIG. 14 used for a smart phone.

The electronic system 900 shown in FIG. 14 may be applied to implement electronic control devices of a variety of electronic devices. FIG. 15 illustrates an example in which an electronic system (900 of FIG. 14) is applied to implement a smart phone (1000). As described above, in a case where the electronic system (900 of FIG. 14) is used as the smart phone 1000, the electronic system (900 of FIG. 14) may be, for example, an application processor (AP), but the inventive concept is not limited thereto.

Figure 16:
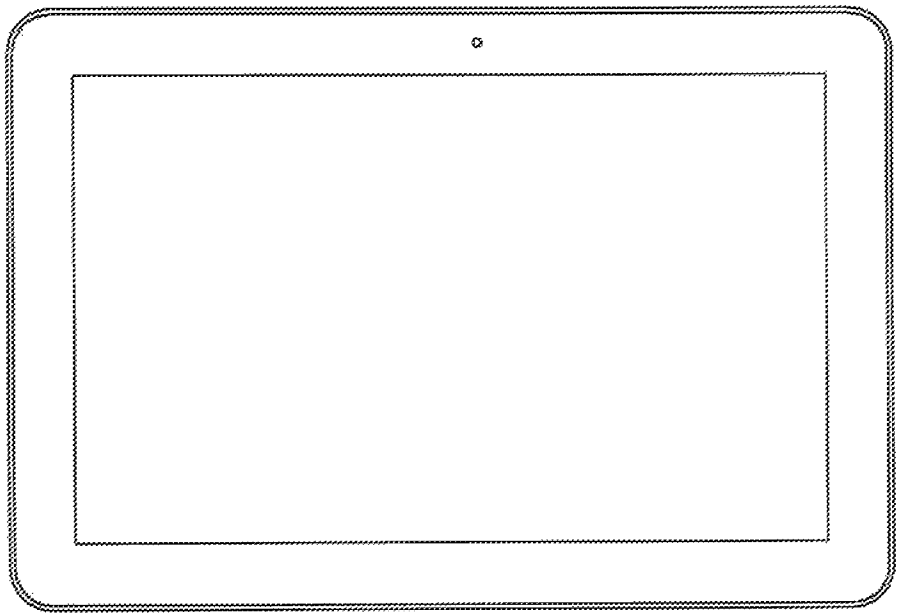
FIG. 16 illustrates an application example of the electronic system shown in FIG. 14 used for a tablet PC.
Figure 17:
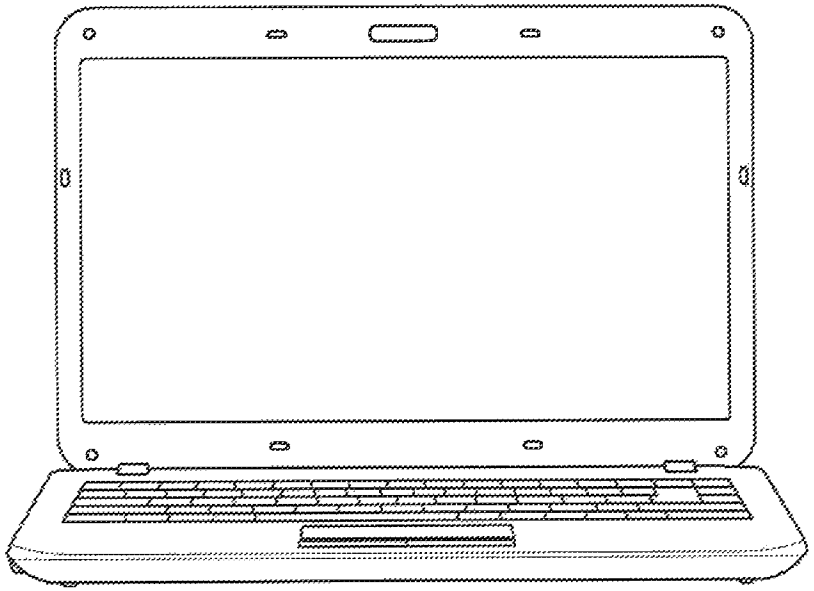
FIG. 17 illustrates an application example of the electronic system shown in FIG. 14 used for a notebook computer.

Meanwhile, the electronic system (900 of FIG. 14) may be applied to electronic control devices of a variety of electronic devices. FIG. 16 illustrates an example in which an electronic system (900 of FIG. 12) is applied to implement a mobile phone (1000). FIG. 17 illustrates an example in which an electronic system (900 of FIG. 14) is applied to implement a tablet PC (1100). FIG. 18 illustrates an example in which an electronic system (900 of FIG. 14) is applied to implement a notebook computer (1200).

In various embodiments, the electronic system (900 of FIG. 14) can be incorporated into a variety of different types of devices, such as computers, ultra mobile personal computers (UMPCs), work stations, net-books, personal digital assistants (PDAs), portable computers, web tablets, wireless phones, mobile phones, smart phones, e-books, portable multimedia players (PMPs), portable game consoles, navigation devices, black boxes, digital cameras, 3-dimensional televisions, digital audio recorders, digital audio players, digital video recorders, digital video players, devices capable of transmitting/receiving information in wireless environments, one of various electronic devices constituting a home network, one of various electronic devices constituting a computer network, one of various electronic devices constituting a telematics network, RFID devices, or computing systems.

Meanwhile, when the electronic device (900 of FIG. 14) is a device capable of performing wireless communication, it may be used in communication systems, e.g., Code Division Multiple Access (CDMA), Global System for Mobile Communications (GSM), North American Digital Cellular (NADC), Extended-Time Division Multiple Access (E-TDMA), Wideband Code Division Multiple Access (WCDMA), and CDMA 2000.

While the inventive concept has been particularly shown and described with reference to exemplary embodiments thereof, it will be understood by those of ordinary skill in the art that various changes in form and details may be made therein without departing from the spirit and scope of the inventive concept as defined by the following claims. It is therefore desired that the present embodiments be considered in all respects as illustrative and not restrictive, reference being made to the appended claims rather than the foregoing description to indicate the scope of the inventive concept.

What is claimed is:

1. A display driving device comprising:

a data compare block configured to receive display data through an input pad and generate control data from the display data;

a logic block that has the data compare block disposed therein and configured to output the control data generated from the data compare block;

a source driver that is configured to supply respective pixel voltages to first and second pixels through one of a first pair of four source amplifiers and to supply respective pixel voltages to third and fourth pixels through one of a second pair of the four source amplifiers according to the display data and control data supplied from the logic block; and a buffer unit that supplies the control data generated by the data compare block and the display data to the source driver, wherein the buffer unit receives the display data and the control data together in serialized form directly from the data compare block and outputs latched data at a predetermined time to the source driver, wherein:

a first pixel voltage is supplied to the first pixel through one of the first and second source amplifiers according to the control data, a second pixel voltage is supplied to the second pixel through one of the first and second source amplifiers according to the control data, a third pixel voltage is supplied to the third pixel through one of the third and fourth source amplifiers according to the control data, and a fourth pixel voltage is supplied to the fourth pixel through one of the third and fourth source amplifiers according to the control data.

2. The display driving device of claim 1, wherein each of the logic block and the data compare block includes digital circuits, and the source driver includes an analog circuit.

3. The display driving device of claim 2, wherein the logic block is disposed adjacent to the source driver.

4. The display driving device of claim 1, wherein the logic block includes a terminal to output the control data.

5. A method for operating a display driving device, the method comprising:

providing first to fourth pixels of a display;

providing first to fourth source amplifiers coupled to the first to fourth pixels, respectively;

supplying display data and control data to a source driver for driving each of the first to fourth pixels of the display, wherein the source driver comprises a buffer unit that receives the display data and control data together in serialized form directly from a data compare block in a logic block, and the first to fourth source amplifiers;

supplying a first pixel voltage to the first pixel through one of the first and second source amplifiers according to the control data, supplying a second pixel voltage to the second pixel through one of the first and second source amplifiers according to the control data, supplying a third pixel voltage to the third pixel through one of the third and fourth source amplifiers according to the control data, supplying a fourth pixel voltage to the fourth pixel through one of the third and fourth source amplifiers according to the control data, wherein the buffer unit comprises:

a first group of shift registers that parallelizes the display data and the control data that are received together in serialized form directly from the data compare block, and a second group of shift registers that parallelizes data output from the first group of shift registers and output latched data at a predetermined time to the source driver.

6. The method of claim 5, wherein the first and second source amplifiers are disposed in the source driver to be adjacent to each other and the third and fourth source amplifiers are disposed in the source driver to be adjacent to each other.

7. A method for operating a display driving device, the method comprising:

providing first to fourth pixels of a display;

providing first to fourth source amplifiers coupled to the first to fourth pixels, respectively;

supplying display data and control data to a source driver for driving each of the first to fourth pixels of the display, wherein the source driver comprises:

a buffer unit that receives the display data and control data together in serialized form directly from a data compare block in a logic block, and the first to fourth source amplifiers;

supplying a first pixel voltage to the first pixel through a selection of one of the first and second source amplifiers according to the control data, supplying a second pixel voltage to the second pixel through a selection of one of the first and second source amplifiers according to the control data, supplying a third pixel voltage to the third pixel through a selection of one of the third and fourth source amplifiers according to the control data, supplying a fourth pixel voltage to the fourth pixel through a selection of one of the third and fourth source amplifiers according to the control data, wherein the control data is a 1 bit digital signal, and wherein a same 1 bit digital signal is configured both to control switches for selecting between source amplifiers and to control operation of source amplifiers selected to supply pixel voltages.

8. The method of claim 7, wherein a first control data is configured to control both the selection between first and second source amplifiers and the supplying of the second pixel voltage by the second source amplifier to the second pixel and a second control data is configured to control both the selection between third and fourth source amplifiers and the supplying of the fourth pixel voltage by the fourth source amplifier to the fourth pixel.

* * * * *